United States Patent [19]

Lenz

[11] Patent Number: 5,024,163

[45] Date of Patent: Jun. 18, 1991

[54] DERAILMENT RESISTING, TRACTIVE POWER RAILWAY SYSTEM

[76] Inventor: Erwin Lenz, 180 Cabrini Blvd., New York, N.Y. 10033

[21] Appl. No.: 488,666

[22] Filed: Mar. 5, 1990

Related U.S. Application Data

[63] Continuation-in-part of Ser. No. 240,036, Sep. 2, 1988, Pat. No. 4,947,646.

[51] Int. Cl.[5] ..... B61C 11/00; B61C 15/02

[52] U.S. Cl. ..... 105/73; 105/170; 105/199.4; 104/243

[58] Field of Search ..... 104/109, 242, 243, 244, 104/247, 306; 105/73, 170, 199.1, 199.4, 199.5, 224.1

[56] References Cited

U.S. PATENT DOCUMENTS

| | | | |
|---|---|---|---|
| 188,611 | 3/1877 | Dutrow | 104/243 |
| 199,974 | 2/1878 | Harding et al. | 104/244 |
| 350,923 | 10/1886 | Eames | 104/244 |
| 379,905 | 3/1888 | Oehrle | 104/244 |
| 415,991 | 11/1889 | Zipernowsky | 104/139 |
| 508,480 | 11/1893 | Kirchner et al. | 104/244 |
| 861,830 | 7/1907 | Hackney | 104/244 |
| 897,978 | 9/1908 | Hicks | 104/247 X |
| 997,148 | 7/1911 | Moofley | 104/244 |
| 1,324,893 | 12/1919 | Hammond | 104/246 |
| 1,522,332 | 1/1925 | Schmitz | 104/306 X |
| 2,361,290 | 10/1944 | Herold | 104/306 X |
| 2,699,733 | 11/1955 | Flowers | 105/199.1 |
| 2,796,841 | 6/1957 | Fahlbusch et al. | 105/199.1 |
| 2,800,861 | 7/1957 | Michalski | 104/246 |
| 3,240,291 | 3/1966 | Bingham | 104/243 X |
| 3,391,652 | 4/1965 | Lauber | 104/247 |
| 3,707,926 | 1/1973 | Ellzey | 104/243 X |
| 3,730,103 | 5/1973 | Weaver | 104/306 X |
| 3,732,828 | 5/1973 | Wanner | 104/243 X |
| 3,807,312 | 4/1974 | Flodell | 104/243 X |
| 3,998,166 | 12/1976 | Morrison | 104/243 |
| 4,389,943 | 6/1983 | Watatani | 105/170 X |

FOREIGN PATENT DOCUMENTS 2226462 12/1973 Fed. Rep. of Germany .

*Primary Examiner*—Robert J. Oberleitner
*Assistant Examiner*—S. Joseph Morano
*Attorney, Agent, or Firm*—Barry G. Magidoff

[57] ABSTRACT

There is provided a multi-rail vehicle system, which can be used to improve the efficiency of existing systems and to reduce risk of derailments. The systems comprises a vehicle designed to ride upon a pair of conventional outer rails and an additional load-carrying central rail. The central rail comprises a pair of slanted rails having external surfaces which extend, preferably, substantially perpendicularly one to the other, and are joined at an apex pointing upwardly. The intersection of the central rail surfaces coinciding, preferably, with the central line of the rail. The vehicle of the present invention comprises a central traction wheel with an axle secured to the vehicle by means permitting vertical linear movement and rotation about a vertical axis, the wheel, being rotatably secured about the horizontal axis of the axle. The vehicle also includes two or more pairs of outer wheels on axles; the wheels are designed to ride upon the three rails.

10 Claims, 8 Drawing Sheets

DERAILMENT RESISTING, TRACTIVE POWER RAILWAY SYSTEM

This application is a continuation-in-part of copending application Ser. No. 240,036, filed Sept. 2, 1988, and now U.S. Pat. No. 4,947,646, Registration Date: Aug. 14, 1990.

The invention relates to a new system for improving conventional existing railroads.

BACKGROUND OF THE INVENTION

With most long distance passenger service having been taken away by the airlines, after World War Two, the railroads were forced to emphasize freight service. More powerful diesel locomotives were built and pneumatic brakes became standard equipment. The freight trains became longer and heavier and at the same time slower.

While passenger service has been taken away by the airlines, freight service to a large extent is being taken away by trucks, which have been able to travel at faster average speeds. The average freight train speed is 20.1 miles per hour, when calculated by dividing total train miles by total train hours; in spite of the slow speed a number of catastrophic train disasters occurred last year. After all, the rate of retardation of a train by its braking system depends upon the wheel-rail adhesion, which is very limited on regular rails. It cannot prevent wheel sliding.

Revitalizing the railroads requires an increase in performance, i.e., in powered acceleration and braking deceleration, which requires improved derailment protection and additional traction, as well as improved safety over track joints, curves and switches.

Many systems have been proposed to solve these problems. Multi-rail systems are described for example in U.S. Pat. Nos. 3,988,166 and 188,611. Spring-loaded guide wheels are shown in U.S. Pat. No. 861,830 and in German Offenlegungsschrift 2,226,462.

None of the prior systems provide the necessary combination of changes required to attain the highest level of performance and safety, utilizing the presently existing systems.

SUMMARY OF THE INVENTION

It is an object of the present invention to provide an improved railroad system with reduced likelihood of derailment, utilizing present roadbeds. It is a further object of this invention to provide means to transmit additional power for driving the rail vehicles. It is yet another object of this invention to provide means for increasing the acceleration of the train and increased braking deceleration. It is yet another object of the invention to provide simple, inexpensive and efficient means to improve the ride of a rail vehicle over joints, curves and switches.

In accordance with this invention, a new system is provided for rail vehicles which can be added on to existing railroad equipment; this invention comprises a supplementary central rail which can be secured between the pre-existing two conventional rails, and a mating pair of supplementary wheels, as an add-on to each vehicle. The supplementary rail is located between the two pre-existing rails and comprises a pair of slanted track surfaces, joined along a longitudinal seam, preferably perpendicular to each other, and each preferably at a 45° angle to the road bed. The intersection of the surfaces preferably is at the uppermost end and coincides with the center line of the rail and the midpoint line between the two pre-existing tracks. The central track surfaces are secured to the road bed by a substantially vertical support.

Each supplementary traction wheel is rotatably, biaxially supported from the vehicle, along a line intermediate the pre-existing wheels, rotatably supported about the usual transverse horizontal axis and about a vertical axis; the wheel is further permitted limited vertical longitudinal motion along the aforesaid vertical axis. The supplemental wheel pair comprises two conjoined conical surfaces, so juxtaposed as to mate with and to press against the two slant track surfaces; this increases the stability of the railroad car, reducing the likelihood of derailment and provides additional traction for powering the vehicle.

The two halves of the traction wheel pair are preferably resiliently secured together, e.g., by spring-loaded bolts, such that the conical surfaces face each other, preferably forming an annular conical concavity which mates with the slanted track surfaces. The spring-loaded bolts, or other biased joining means, permit adjustment of the wheel halves to compensate for wear, and to provide horizontal forces against the central rail.

The traction wheel is supported from the railroad car and rotatably secured about a horizontal axle. As a further improvement of this invention, the horizontal axle, rotatably supporting the traction wheel, is rotatably and vertically movably secured to the vehicle chassis.

In a preferred embodiment, the supplemental wheel axle is secured to one of a pair of vertically aligned, interleaved cylindrical tank halves mutually rotatable about a vertical axis. The upper cylindrical tank half further is rigidly secured to the vehicle chassis and the lower tank half is permitted limited vertical travel relative to the chassis. The tank is also partially filled with a lubricating liquid.

Optimally, the supplementary wheel can be driven by an auxiliary motor, preferably a hydraulic-powered system; that increases the tractive power, most preferably making each railroad car all, or almost wholly, self propelled.

The freedom of rotation about a vertical axis permitted the supplementary wheels, improves the ability of the wheels to move around curves, by maintaining the horizontal axis of the wheels substantially in line with the radius of the curve.

The limited relative vertical linear movement permitted the wheel, improves the ability of the train to move through the switches. The central traction rail must end before the switch; the longitudinal vertical movement of the wheel permits gradual disengagement and re-engagement of the wheel, preferably also including cushioning means to reduce stress, e.g., by providing pneumatic damping.

DETAILED DESCRIPTION OF THE DRAWINGS

Figure 1:
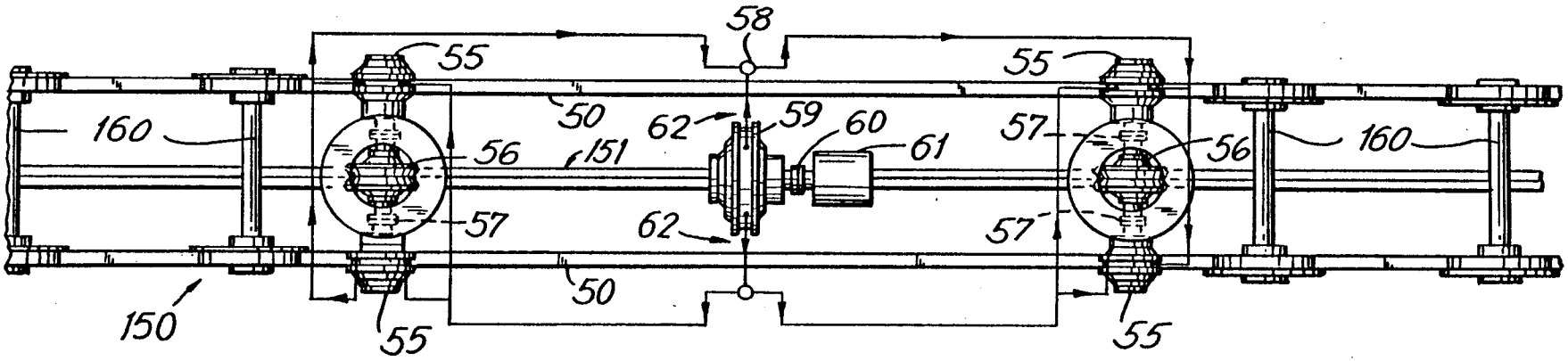
FIG. 1 is a top plan diagrammatic view of the railroad system of this invention.

The present invention provides means to improve an existing railroad system, including two conventional rails 50, by providing a central traction rail generally indicated by the numeral 151, installed in centered position between the conventional rails. Two sets of traction wheels generally indicated by the numeral 56, are each driven by two slave hydraulic motors 55, each connected to a wheel 56 through a clutch 57 and then to the axle 3. In turn, the slave hydraulic motors 55 are driven by a master hydraulic rotor 59 powered by an electric motor 61 through a clutch 60. The slave and the master hydraulic systems are connected through a fluid piping system, generally designated as 62, having rotatable joints 58. The railroad car, generally designated by the numeral 150, includes four pairs of general support wheels 160, usually called "trucks". This hydraulic system is of a type shown in my copending application Ser. No. 240,036, filed on Sept. 2, 1988, the disclosure of which is incorporated herein by reference.

Figure 2:
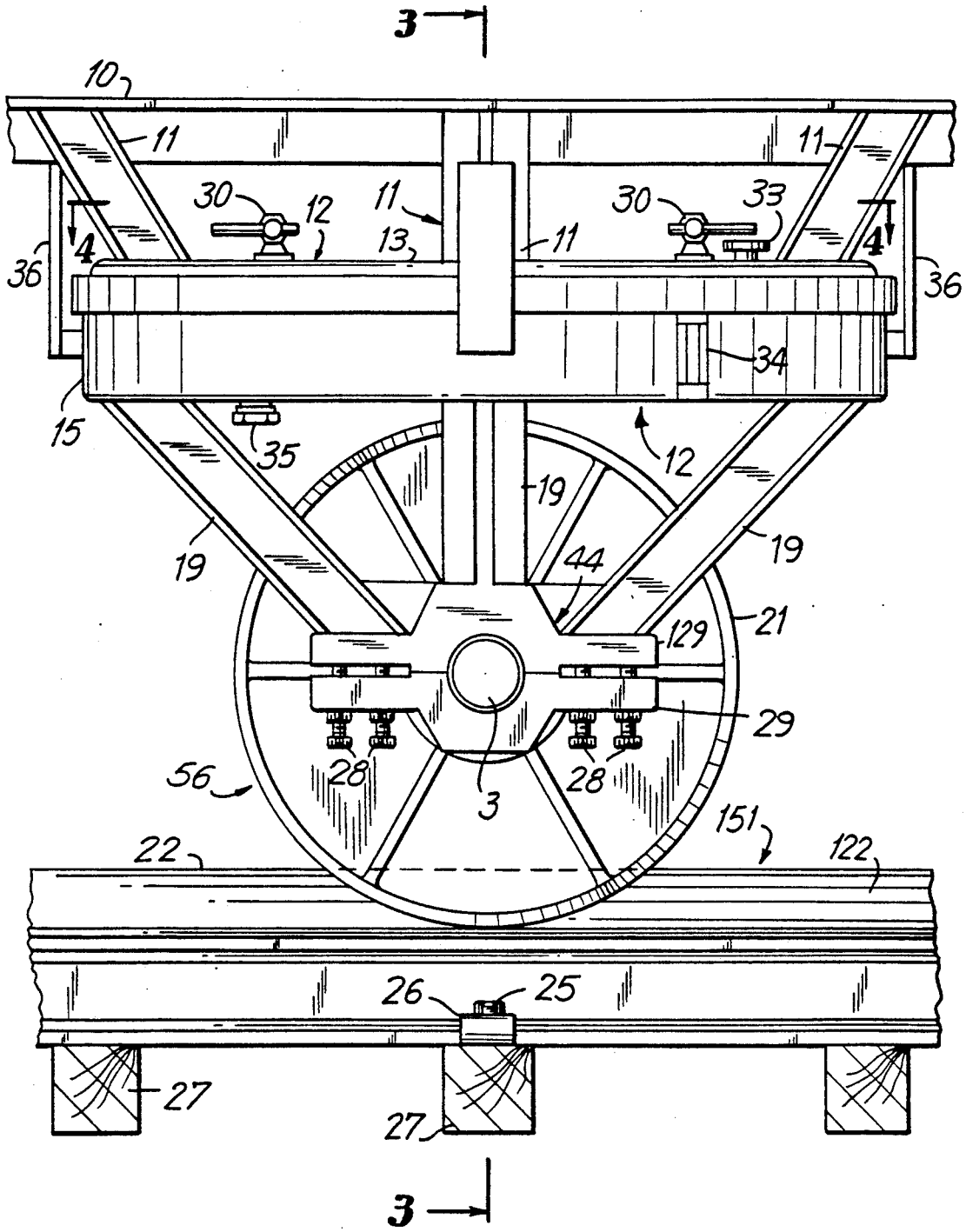
FIG. 2 is a side elevation view partially broken away of the middle traction rail and wheel of FIG. 1.
Figure 3:
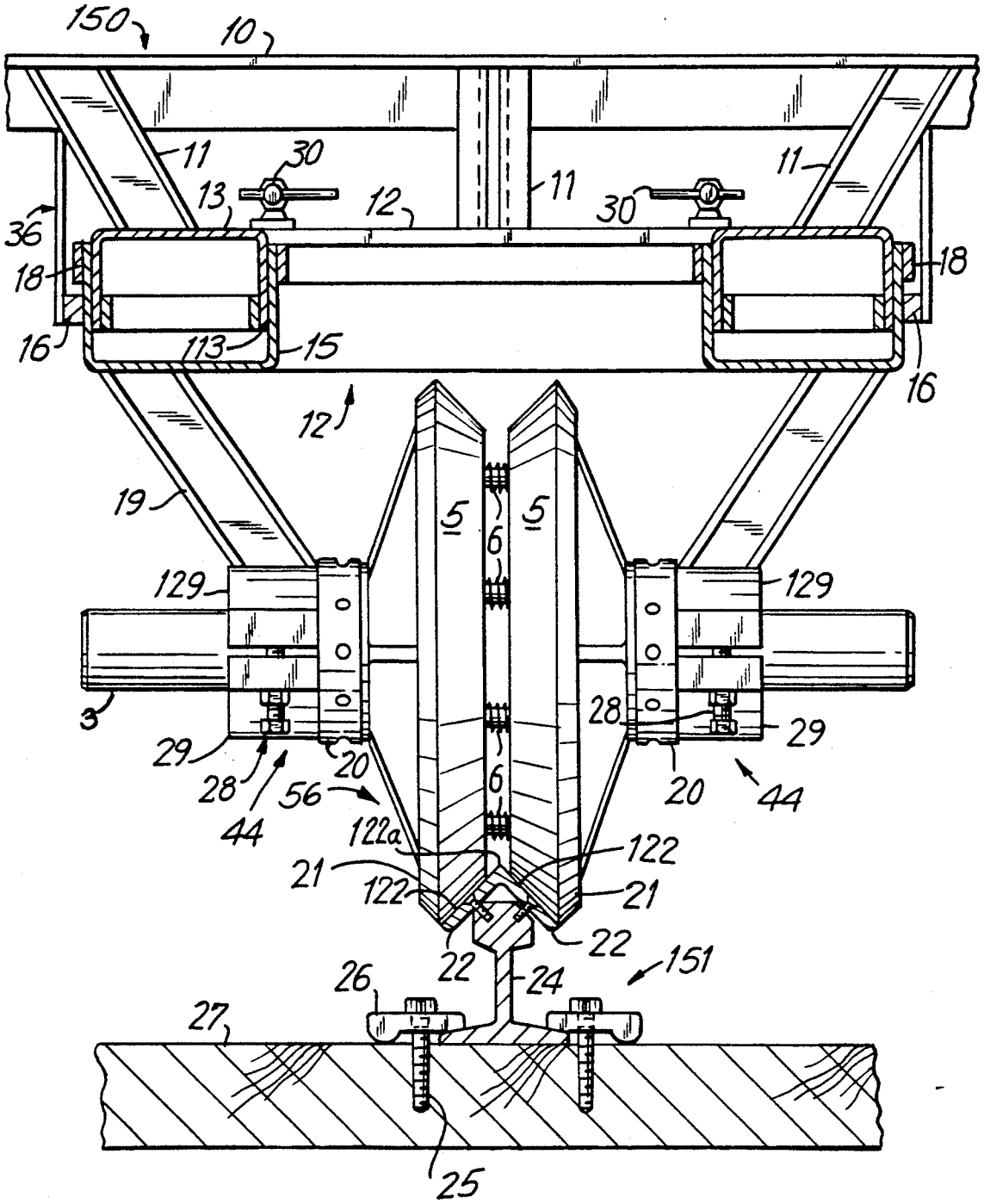
FIG. 3 is a front elevation view, partially sectioned taken along lines 3—3 of FIG. 2.
Figure 4:
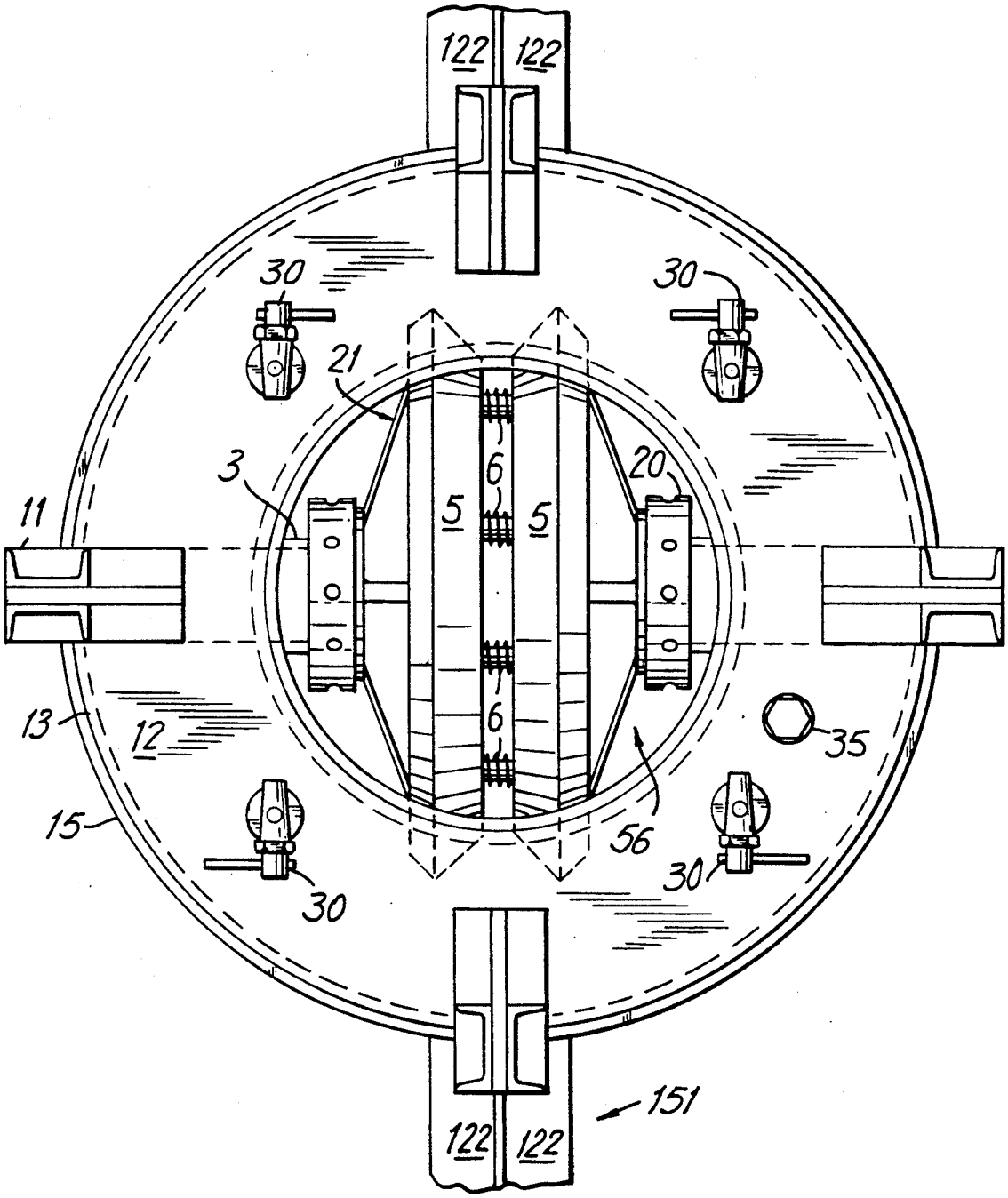
FIG. 4 is a top plan view, partially sectioned, of the traction wheel and support, taken along lines 4—4 of FIG. 2.
Figure 5:
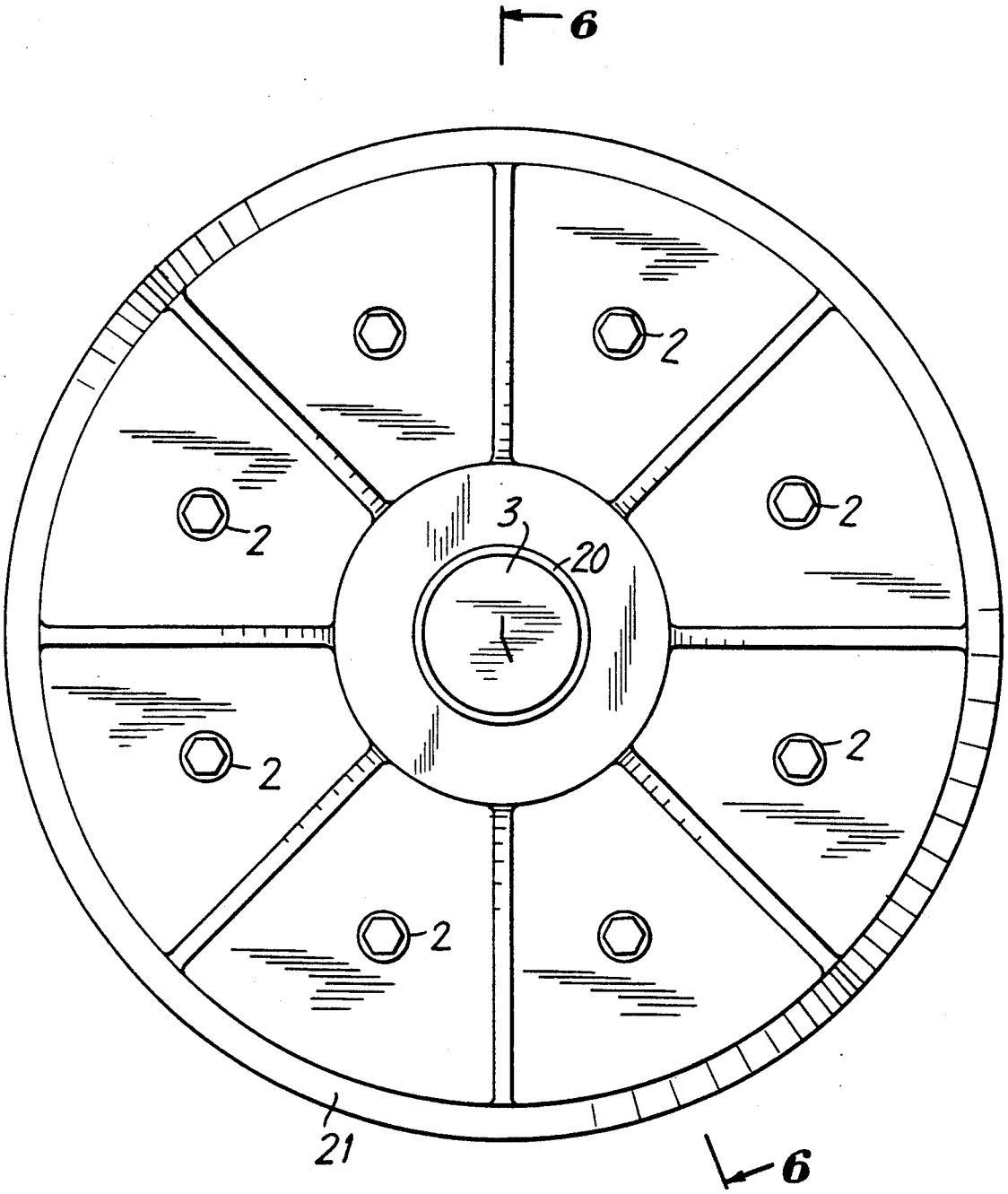
FIG. 5 is a side view of the traction wheel of FIG. 2.
Figure 6:
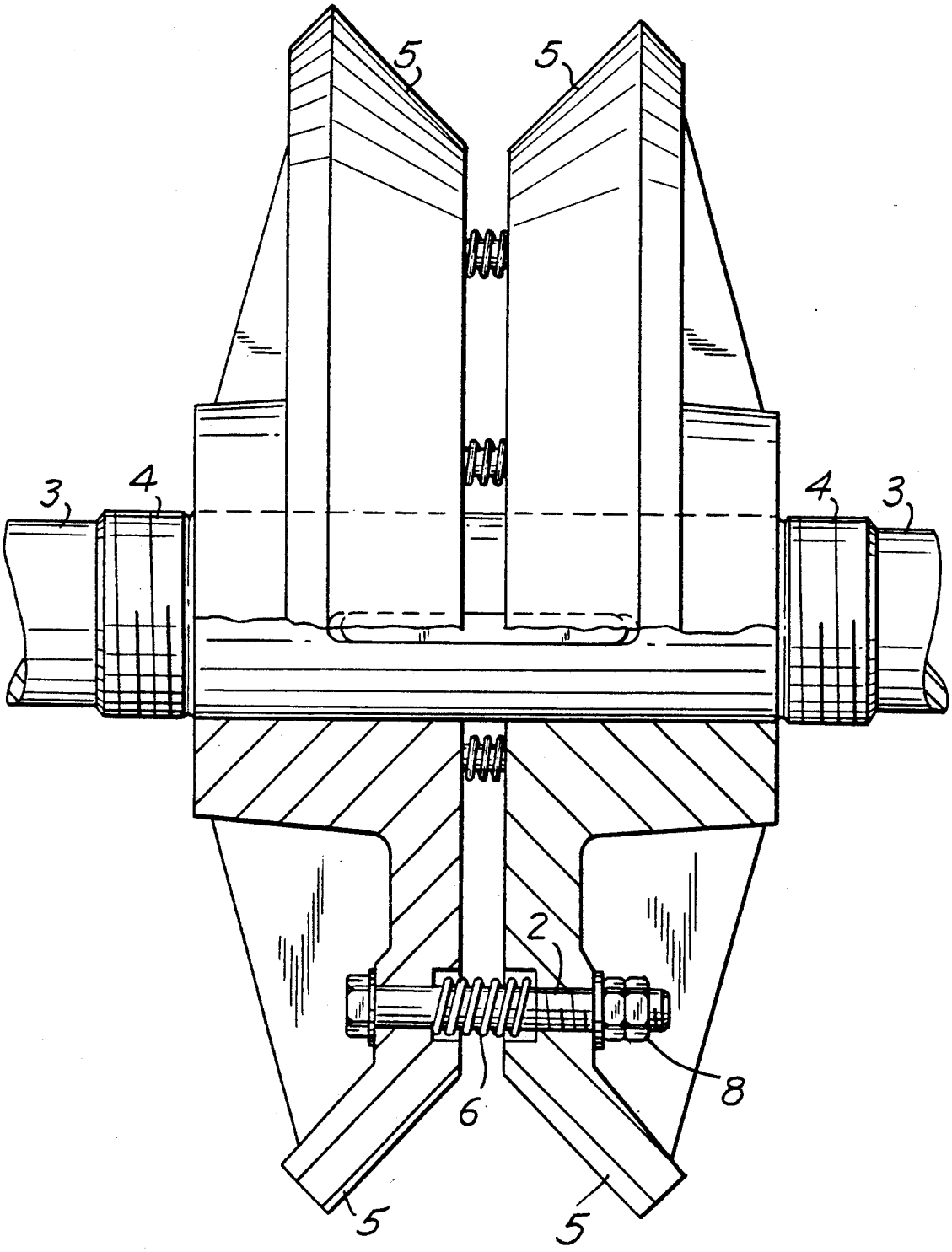
FIG. 6 is a front elevation view, partially sectioned, of the traction wheel, taken along lines 6—6 of FIG. 5.
Figure 7:
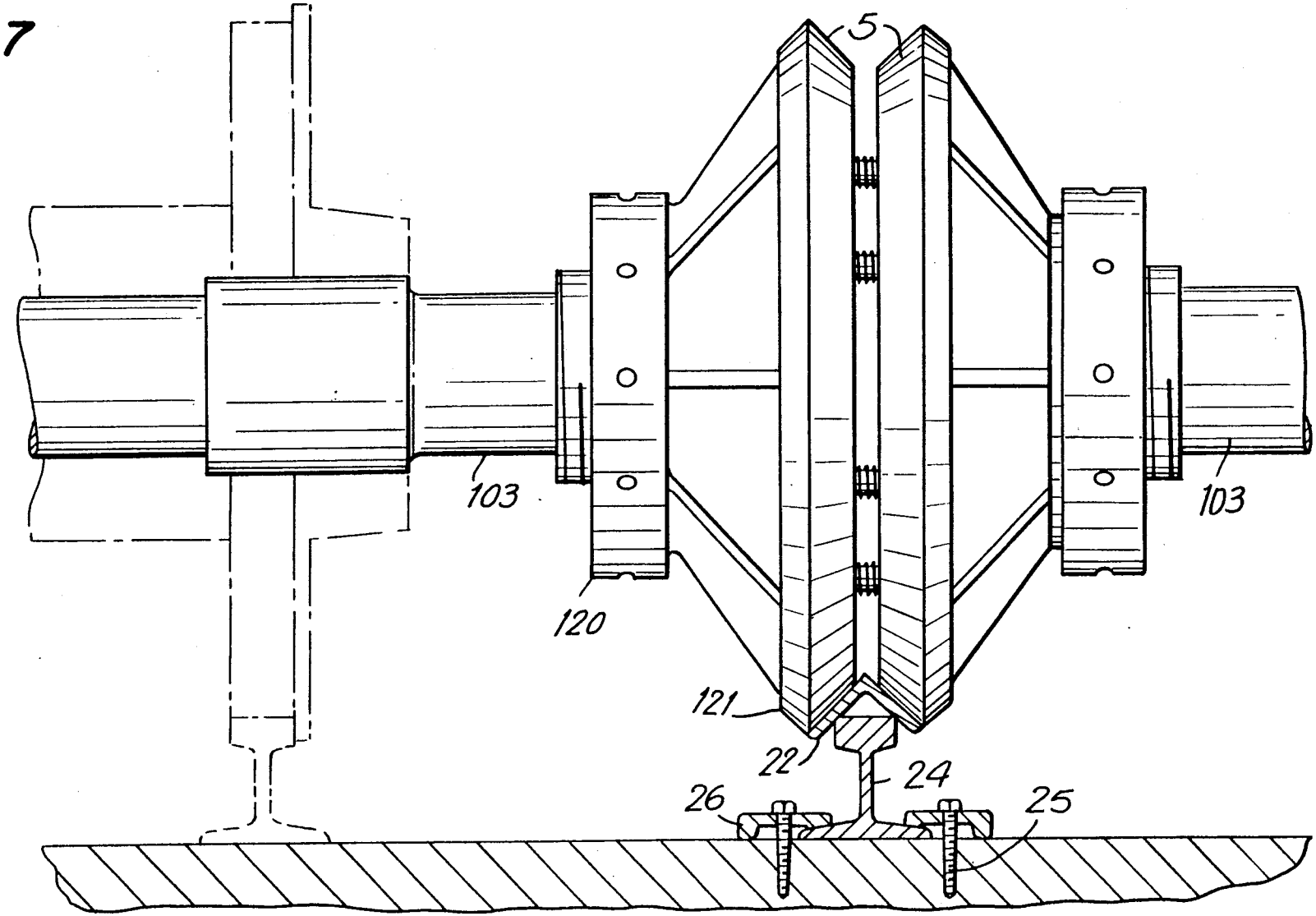
FIG. 7 is a front view of a second embodiment of the traction wheel of the present invention.
Figure 9:
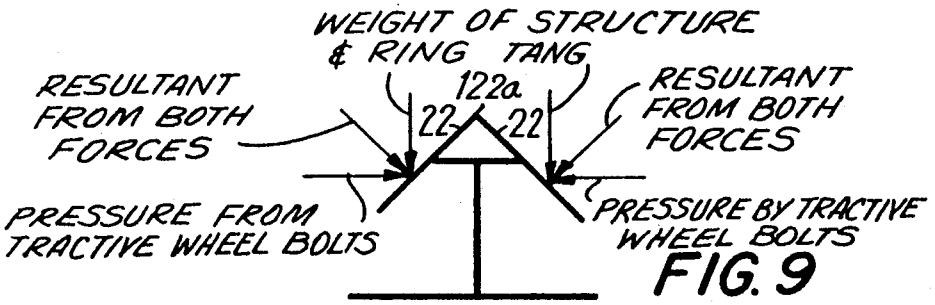
FIG. 9 is a vector diagram, showing the combination of forces acting between the traction rail and wheel of the present invention.

Referring to FIGS. 2 and 3, a track support 24 is rigidly secured at its lower end to cross ties 27 by spikes 25 and clamps 26. The track support 24 is secured at its upper end to two slant track members 22, having outer upwardly facing surfaces 122, preferably perpendicular to each other; preferably, the intersection 122*a* of the slant surfaces 122 coincides with the center line of the two conventional rails 50 and of the central traction rails 22.

Each traction wheel 56 includes paired identical wheel members 21, supported on a threaded axle 3, and secured by a pair of ring nuts 20 threaded onto the axle 3 at the threaded portions 4; the paired wheel members 21 are also maintained in the desired juxtaposition by eight spring-biased bolts 2 and nuts 8, including helical springs 6. Paired conical surfaces 5 formed on the two wheel members 21, respectively, are designed to mate with the slant track surfaces 22, extending, in this preferred embodiment, substantially perpendicular to each other. The pair of traction wheel members 21 and the axle 3 are rotatably supported by a pair of bearing housings, generally denoted by the numeral 44, which are each formed of upper and lower bearing halves 29, 129. The two bearing halves are clamped together by lock nuts and bolts 28. The diameter of the axle 3 in the portion between the ring nuts 20 is larger comparatively to the other portions of the axle 3. The threads 4 are cut on the axle on either side of the traction wheel 56. The axle 3, as shown in FIG. 1, extends on both sides of the wheel 56 to the clutches 57, which are in turn each connected to hydraulic drive motor 55.

The juxtaposed conical surfaces 5 of the wheel 56 are sand-blasted and epoxy coated to improve traction. The tension applied by the eight spring-biased bolts 2 to the two wheel members 21, can be adjusted with nuts 8 to maintain the desired equidistant relationship around the entire circumference of the conical surfaces 5, relative to each other and to the central track surfaces 22.

The axle 3 of the tractive wheel is secured to the chassis 10 of the train via the bearing housings 44, a rotatable, slidable annular support system formed from a pair of interleaved annular tanks, generally designated by the numeral 12, and two sets of channel beams 11, 19. The ring tank 12 comprises a pair of annular ring tank halves 13,15, the upper ring-tank half 13 being rigidly secured to the railroad car chassis 10 through one set of channel beams 11 and the lower ring-tank half 15 being rigidly secured to the traction wheel bearing housings 44 through the second set of channel beams 19. The ring-tank halves 13, 15 are rotatably and axially slidably mated about a vertical axis, fitting one within the other; the lower ring tank-half 15 opens upwardly; the upper ring tank-half 13 opens downwardly and fits snugly, but slidably, within the lower ring tank half 15, with about 0.005 in. clearance. The two ring-tank halves 13, 15 are so fit together and juxtaposed to permit relative rotary movement as well as relative longitudinal movement. The relative longitudinal movement is limited by the annular ring block 18 secured to the upper exterior surface of the lower ring- tank half 15, and a fixed block 16 rigidly secured to a gusset 36, which in turn is rigidly connected to the car chassis 10; under normal riding conditions, the upper ring-tank half 13 preferably floats above the lower tank half 15, such that the stop members 16,18 are not usually in contact.

Four air relief valves 30 are located on the upper ring-tank half 13 so as to regulate the shock absorbing effect by varying the amount of air within the annular ring tank 12. For improved rotary and longitudinal movement the annular space defined by the mating ring-tank halves 13, 15 is partially filled through an inlet 33 with a high viscosity lubricant liquid, up to about 30% of the minimum volume of the ring-tank space; the lubricant liquid can be drained out through outlet 35. A liquid gauge 34 indicates the amount of lubricant in the tank. The volume of lubricant can be increased or decreased through the inlet 33 and outlet 35. The volume of lubricant liquid is preferably at least enough to cover the lower edge 113 of the upper tank 13 when the stop blocks 16, 18 are in contact.

In the most preferred embodiment of this invention, each railroad car is 95% self propelled and self braking. The locomotive furnishes the propulsive force when the train goes over switches where the center-rail ends. The locomotive also preferably furnishes all the electricity needed for power and light, generated by separate electric motor-generator unit, inside the locomotive.

Another important function of the ring-tank 12 is to isolate the weight of the railroad car from the traction wheel 56. The weight that rests on the axle of the tractive wheel consists only of the following members suspended from the lower ring tank half 15, i.e., the bearings 44, the wheel 56, the lower channel beam structure 19, the lower portion of the ring tank 15 plus the lubricant fill, and the two hydraulic drive Rotators 55. These are the vertical forces to be carried by the center-rail 151.

The horizontal forces on the center rail 151 are determined by the wheel bolts 2 and thus are adjustable. By adjusting the tension on the wheel bolts 2, by rotating the nuts 8, the resultant force exerted by the wheel 56 can be made to act perpendicularly to the top surfaces 122 of the center rail 151.

As shown in the schematic drawing No. 6, the ring tank also allows the tractive wheel to adjust itself to a curve in the rail in such a manner that the axis of the wheel points to the center of the curve, which is necessary in order to avoid jamming of the wheel in curves.

The forces exerted through the traction wheels 56 against the central track 151 are created by the weight of the structure, exerted downwardly, and (when traveling around a curve) the sideward centrifugal force effect, acting perpendicularly to the weight from the wheels. The resultant of these two force vectors acts between the two wheels, preferably perpendicular to the top surfaces 122 of the central track members 21. The sideways forces are transmitted through the wheel bolts, which secure together the two wheel members 21.

Figure 8:
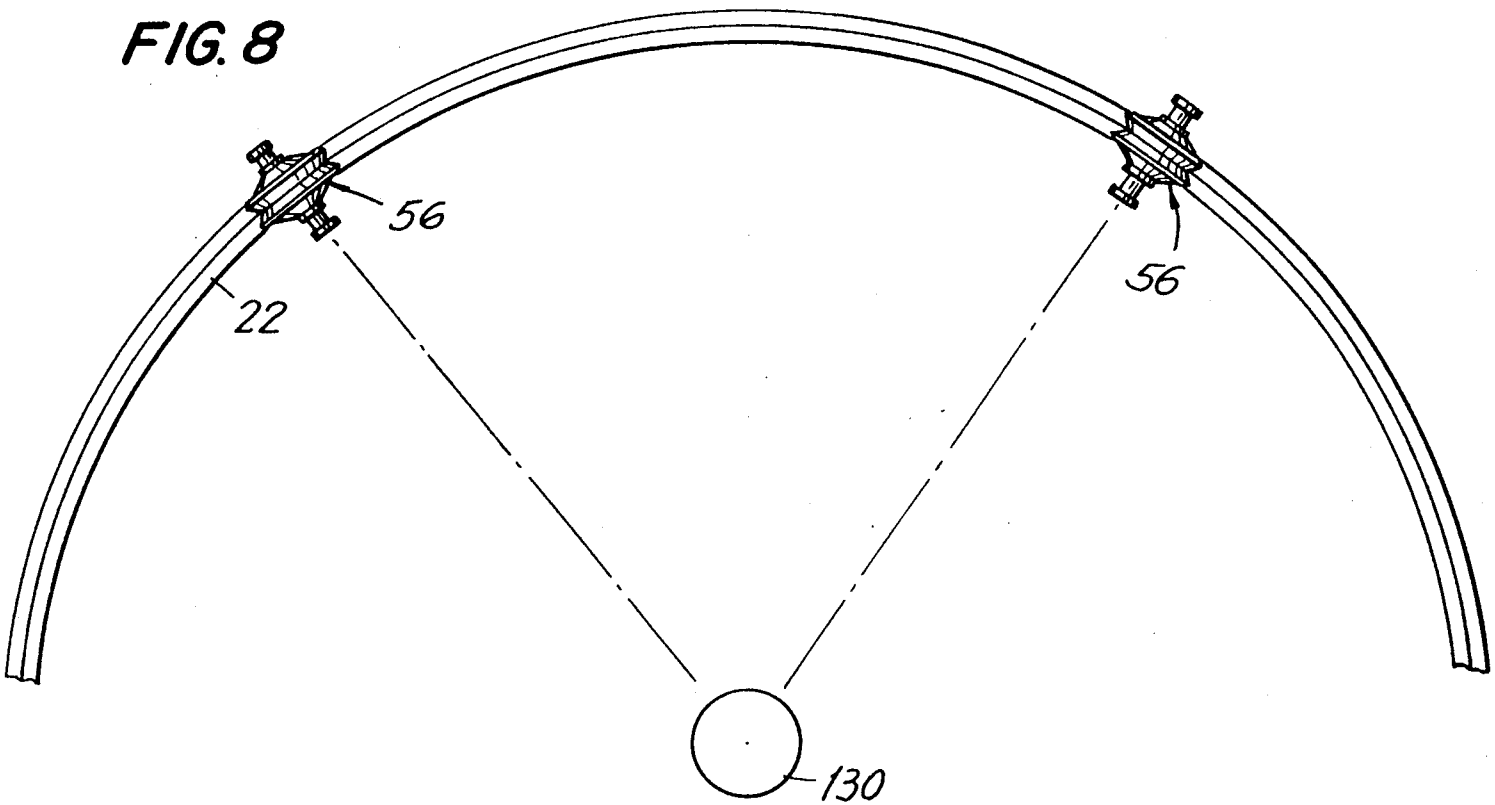
FIG. 8 is a schematic plan illustrating the movement of the traction wheel of this invention as the train goes around a curving rail.

The correct attitude of the traction wheels 56 with respect to the central rails 22 is maintained, as shown in FIG. 8, as a result of the ability of the wheel's axle 3 to rotate about its vertical axis. In this manner, the centrifugal reaction effect force is always acting parallel to the axis of the wheel, and friction loss is thus reduced, regardless of the curve diameter about which the train may move; the likelihood of derailment is thus reduced.

The two wheel members 21, can be maintained in their proper juxtaposition, even after wearing of the conical surfaces 5, e.g., as from friction, by adjustment of the ring nuts 20 and/or of the biased wheel bolts 2, to maintain the desired separation and parallelism. The helical springs 6 act to push the two wheel members 21 apart.

The patentable embodiments of this invention which are claimed as follows:

1. In a conventional railroad system comprising a pair of standard railroad rails and a standard railroad car riding along said rails, the improvement which comprises a supplementary central rail secured intermediate the pair of conventional railroad rails, the supplementary rail comprising a vertical support secured intermediate the two conventional rails and a pair of upwardly facing slanted track surfaces supported by the vertical support, the slanted track surfaces intersecting at a central portion of the supplementary rail; and, independently suspended from the railroad car, a supplementary traction wheel, separately secured to the railroad car along a line intermediate conventional pairs of wheels; a support system securing the supplementary traction wheel to the railroad car independently of the conventional pairs of wheels, so as to permit rotation about the horizontal axis of the supplementary traction wheel, limited vertical movement, and at least limited rotation about a vertical axis of the support system, the support system comprising horizontal axle means permitting rotation of the supplementary traction wheel about its horizontal axis, and vertical support means rotatably and slidably connected to the railroad car so as to permit rotation about the vertical axis and limited longitudinal motion along the vertical axis; the supplementary traction wheel comprising a pair of intersecting conical circumferential surfaces so juxtaposed as to mate with the slanting track surfaces when the conventional wheels are riding on the conventional rails.

2. The railroad system of claim 1 comprising switch means secured to the rails.

3. In a conventional railroad system comprising a pair of standard railroad rails and a standard railroad car riding along said rails, the improvement which comprises a supplementary central rail secured intermediate the pair of conventional railroad rails, the supplementary rail comprising a vertical support secured intermediate the two conventional rails and a pair of upwardly facing slanted track surfaces supported by the vertical support, the slanted track surfaces intersecting at a central portion of the supplementary rail; and, suspended from the railroad car, a supplementary traction wheel, secured along a line intermediate conventional pairs of wheels; a support system securing the supplementary traction wheel to the railroad car so as to permit rotation about the horizontal axis of the wheel, limited vertical movement, and at least limited rotation about a vertical axis, of the supplementary traction wheel the support system comprising: horizontal axle means permitting rotation of the supplementary traction wheel about its horizontal axis, and vertical support means rotatably and slidably connected to the railroad car so as to permit rotation about the vertical axis of the supplementary traction wheel and limited longitudinal motion along the vertical axis, the vertical support means comprising an upper portion rigidly secured to the railroad car, a lower portion comprising bearing means rotatably supporting the horizontal axle means, an intermediate portion, rigidly secured to the lower portion, and, slidably rotatably and axially movably secured to the upper portion for movement about and along the vertical axis of the wheel, and fluid damping means formed between the intermediate portion of the support system and the upper portion, and designed to limit the velocity and the extent of vertical axial movement of the supplementary wheel; and the supplementary traction wheel comprising a pair of intersecting conical circumferential surfaces so juxtaposed as to mate with the slanting track surfaces.

4. The railroad system of claim 3 wherein the supplementary traction wheel comprises two wheel members, a conical surface formed on each wheel member, the conical surfaces being substantially congruent and facing each other, such that the smaller diameter portion of each conical surface is proximal the other wheel member, the conical surfaces being in direct contact with the slanted track surfaces, the slanted track surfaces intersecting each conical surface at its vertically uppermost ends.

5. The railroad system of claim 4, comprising pressure relief means for the fluid damping system.

6. The railroad system of claim 4 wherein the two wheel members are biasedly secured together.

7. The railroad system of claim 4 comprising a hydraulic motor, operatively connected to each supplementary traction wheel so as to drive the supplementary traction wheel.

8. The railroad system of claim 2 wherein the conical surfaces of the supplementary traction wheel and the slanted track surfaces extend at 90° to each other, respectively, and wherein the conical surfaces are separated by a finite distance.

9. An improved railroad car, designed for use upon a rail system comprising three rails, including a central rail having a pair of upwardly facing slanted track surfaces, the planes of which intersect at a central upper location, the railroad car comprising:

(a) a chassis and at least two pairs of side supporting wheels secured to the chassis;

(b) a supplementary wheel suspended substantially along the center line of the car, longitudinally and transversely intermediate the side wheels, the supplementary wheel comprising a pair of wheel members each having an outer circumferential conical surface, the conical surfaces being substantially congruent and so conjoined that the smaller diameter edges are proximal to but separated one from the other, the pair of wheel members being resiliently and adjustably held together to permit adjusting the separation between them;

(c) a supplemental axle secured to the pair of wheel members and rotatable about a horizontal axis;

(d) a support system designed to support the supplemental axle from the railroad car, to permit at least limited rotation about a vertical axis and vertical linear movement, and comprising a first support member rigidly secured to the car and a second support member rotatably supporting the supplemental axle and the first support member having a cylindrically shaped outer cross-section and being slidably held within the inner circumference of the second support member to permit relative rotation about a vertical axis and vertical movement, and a damping fluid retained between the first and second support member; and (e) drive means secured to the supplemental axle.

10. The improved railroad car of claim 9, wherein each of the first and second support members is formed in the shape of an annular tank.

* * * * *

UNITED STATES PATENT AND TRADEMARK OFFICE

CERTIFICATE OF CORRECTION

PATENT NO. : 5,024,163

DATED : June 18, 1991

INVENTOR(S) : Erwin Lenz

It is certified that error appears in the above-identified patent and that said Letters Patent is hereby corrected as shown below:

Claim 8, line 1 (Column 6, line 53), delete "claim 2 and substitute therefor --claim 3--.

Signed and Sealed this

Thirteenth Day of October, 1992

*Attest:*

DOUGLAS B. COMER

*Attesting Officer*

*Acting Commissioner of Patents and Trademarks*